US007159974B2

(12) United States Patent
Gray et al.

(10) Patent No.: US 7,159,974 B2
(45) Date of Patent: Jan. 9, 2007

(54) SEMIPERMEABLE MEMBRANE FOR AN INK RESERVOIR AND METHOD OF ATTACHING THE SAME

(75) Inventors: Trevor D. Gray, Midway, KY (US); Matthew J. Russell, Stamping Ground, KY (US); Ann M. Trebolo, Nicholasville, KY (US)

(73) Assignee: Lexmark International, Inc., Lexington, KY (US)

( * ) Notice: Subject to any disclaimer, the term of this patent is extended or adjusted under 35 U.S.C. 154(b) by 312 days.

(21) Appl. No.: 10/679,897

(22) Filed: Oct. 6, 2003

(65) Prior Publication Data

US 2005/0073560 A1 Apr. 7, 2005

(51) Int. Cl.
*B41J 2/175* (2006.01)

(52) U.S. Cl. ..... 347/86; 347/87

(58) Field of Classification Search ..... 347/85, 347/86, 87, 92

See application file for complete search history.

(56) References Cited

U.S. PATENT DOCUMENTS 3,953,862 A * 4/1976 Amberntsson et al. ..... 347/87
4,422,085 A 12/1983 Sumitomo et al.
4,571,599 A 2/1986 Rezanka
4,771,295 A * 9/1988 Baker et al. ..... 347/87
4,794,409 A * 12/1988 Cowger et al. ..... 347/87
4,937,598 A 6/1990 Hine et al.
5,040,002 A * 8/1991 Pollacek et al. ..... 347/87
5,047,790 A * 9/1991 Cowger et al. ..... 347/87
5,189,438 A 2/1993 Hine et al.
5,363,130 A 11/1994 Cowger et al.
5,371,529 A 12/1994 Eguchi et al.
5,488,400 A 1/1996 Crystal et al.
5,515,092 A 5/1996 Swanson et al.
5,538,586 A 7/1996 Swanson et al.
5,594,483 A 1/1997 Kaplinsky et al.
5,600,358 A 2/1997 Baldwin et al.
5,640,186 A 6/1997 Swanson et al.
5,686,948 A 11/1997 Crystal et al.
5,686,949 A 11/1997 Swanson et al.
5,737,002 A 4/1998 Swanson et al.
5,801,737 A * 9/1998 Sato et al. ..... 347/86
5,812,168 A 9/1998 Pawlowski, Jr. et al.
5,844,577 A 12/1998 Pawlowski, Jr.
5,874,978 A 2/1999 Swanson et al.
5,896,153 A 4/1999 Swanson et al.
5,984,463 A 11/1999 Kozmiski et al.
6,000,788 A * 12/1999 Iida ..... 347/86
6,003,984 A 12/1999 Bohorquez et al.
6,033,610 A 3/2000 Swanson et al.
6,199,979 B1 3/2001 Hobson et al.

(Continued)

FOREIGN PATENT DOCUMENTS

JP 11254693 9/1999

(Continued)

*Primary Examiner*—Anh T. N. Vo
(74) *Attorney, Agent, or Firm*—Taft, Stettinius & Hollister LLP

(57) ABSTRACT

An inkjet assembly comprising a vented ink reservoir for containing a liquid ink therein, the vented ink reservoir defining an internal volume occupied at least in part by a semipermeable membrane in fluid communication with a vent that automatically adjusts for pressure differentials by enabling gaseous diffusion between an environment external to the vented ink reservoir and the internal volume of the vented ink reservoir, while inhibiting liquid diffusion therethrough. A method is also disclosed for mounting the semipermeable membrane to at least one of an ink reservoir cap and an ink tank.

19 Claims, 5 Drawing Sheets

U.S. PATENT DOCUMENTS

| | | | | |
|---|---|---|---|---|
| 6,243,117 | B1 | 6/2001 | Brandon et al. | |
| 6,250,752 | B1 * | 6/2001 | Tajima et al. | 347/92 |
| 6,257,715 | B1 * | 7/2001 | Thielman et al. | 347/92 |
| 6,283,588 | B1 | 9/2001 | Brandon et al. | |
| 6,454,387 | B1 * | 9/2002 | Haldorsen | 347/29 |
| 6,540,321 | B1 * | 4/2003 | Hirano et al. | 347/22 |
| 6,558,633 | B1 | 5/2003 | Ecker et al. | |
| 6,837,921 | B1 * | 1/2005 | Inoue et al. | 96/6 |
| 2001/0028866 | A1 | 10/2001 | Ecker et al. | |
| 2002/0090738 | A1 | 7/2002 | Cozzette et al. | |
| 2003/0064422 | A1 | 4/2003 | McDevitt et al. | |

FOREIGN PATENT DOCUMENTS

| | | | |
|---|---|---|---|
| JP | 2000190522 | A * | 7/2000 |

* cited by examiner

SEMIPERMEABLE MEMBRANE FOR AN INK RESERVOIR AND METHOD OF ATTACHING THE SAME

BACKGROUND

1. Field of the Invention

The present invention is directed to a vented ink reservoir for facilitating gaseous communication between an interior of an ink reservoir and an external environment; and, more particularly to a vented ink reservoir utilizing a semipermeable membrane to enable the ingress and/or egress of gas with respect to an interior volume of the ink reservoir, where the ink reservoir includes a backpressure regulator housed therein that prevents weeping from one or more printhead nozzles in fluid communication therewith.

2. Background of the Invention

Inkjet pens consist of a jetting structure and an ink containing structure. These structures can be combined into a single integrated cartridge, or separated into tanks and printheads. In either situation, the ink that is fed to the jetting structure must be kept at a negative pressure with respect to pressure outside the pen to prevent the ink from running out of the pen due to gravity, also known as weeping.

Several methods are known for the control of this negative pressure, also known as "backpressure". In some inkjet structures the backpressure is provided by capillary action from a foam sponge, while other structures seal up the system and use a regulation device or a bubble-generating device to allow air to replace spent ink within the system while maintaining a reasonable range of backpressures. Still further systems are sealed off and start at a moderate backpressure and increase in backpressure until the jetting device can no longer pull ink from the reservoir.

Prior art techniques have attempted to control backpressure by providing a collapsible bag acting as the reservoir. The volume of the bag decreases in proportion to the volume of ink leaving the reservoir. However, these collapsible bags require multiple seals and have been found to be problematic to fabricate.

SUMMARY OF THE INVENTION

The present invention is directed to a semipermeable membrane operatively coupled to an ink reservoir vent that allows gaseous communication between an external atmosphere and an interior of the ink reservoir. The semipermeable membrane inhibits liquid ink from passing therethrough, but enables the ingress or egress of gas to provide a venting function.

In an exemplary embodiment, the present invention is teamed with an internal backpressure regulator. The backpressure regulator is submerged within the reservoir and relies, at least in part, upon the pressure differential between the exterior and interior of the regulator for normal operation. The invention allows the ingress of gas into and the egress of gas out of the ink reservoir to approximate equalization of the pressure between the interior of the reservoir and the exterior environment to maintain a sufficient gradient between the inside and outside of the regulator. A more detailed explanation of the backpressure regulator can be found in co-pending U.S. patent application Ser. No. 10/465,403, the disclosure of which is hereby incorporated by reference.

It is a first aspect of the present invention to provide an inkjet assembly that includes a vented ink reservoir for containing a liquid ink therein, where the vented ink reservoir defines an internal volume occupied at least in part by a semipermeable membrane in fluid communication with a vent that automatically adjusts for pressure differentials by enabling gaseous diffusion between an environment external to the vented ink reservoir and the internal volume of the vented ink reservoir, while inhibiting liquid diffusion therethrough.

In a more detailed embodiment of the first aspect, at least a portion of the semipermeable membrane is adapted to be above a highest level of the liquid ink within the internal volume of the vented ink reservoir. In another more detailed embodiment, the semipermeable membrane is operatively coupled to the ink reservoir by impulse sealing. In yet another more detailed embodiment, the semipermeable membrane includes polytetrafluoroethylene. In a further detailed embodiment, the semipermeable membrane defines a non-circular gaseous throughput. In yet a further more detailed embodiment, the semipermeable membrane is angled with respect to a level of ink within the ink reservoir. In another detailed embodiment, the semipermeable membrane includes a cross-sectional area for gaseous throughput ranging from between about 0.5 $cm^2$ to about 6 $cm^2$. In yet another more detailed embodiment, the vented ink reservoir includes a cap mounted to a tank, and the semipermeable membrane is mounted to the cap. In still a further more detailed embodiment, the cap includes a raised hump providing a space adapted to trap gas therein above a highest level of liquid ink within the vented ink reservoir, and at least a portion of the semipermeable membrane extends into the space provided by the raised hump.

In a more detailed embodiment of the first aspect, a bottom surface of the cap partially defining the internal volume includes a downwardly extending closed wall seating the semipermeable membrane thereto to define a gaseous cavity within the internal volume. In a further detailed embodiment, a bottom surface of the cap includes a downwardly extending closed wall to which the semipermeable membrane is mounted thereto to define a gaseous cavity within the internal volume, and a top surface of the cap includes a humped portion corresponding to a raised space within the bottom surface of the cap adapted to be occupied by a trapped gas, where at least a portion of the semipermeable membrane is in gaseous communication with the trapped gas. In yet a further detailed embodiment, the gaseous cavity formed by the downwardly extending closed wall occupies a portion of the raised space. In a more detailed embodiment, the cap includes an ink inlet adapted to be in fluid communication with the internal volume of the vented ink reservoir. In another more detailed embodiment, the cap includes a serpentine tunnel extending therealong in fluid communication with the vent.

It is a second aspect of the present invention to provide a method of regulating the pressure between an interior volume of an ink container and an external environment, where the method includes the steps of: (a) positioning a semipermeable membrane within an ink container, where the semipermeable membrane includes a first surface in fluid communication with an interior volume of the ink container and an opposing surface in fluid communication with an external environment; (b) mounting the semipermeable membrane to the ink container; and (c) regulating a pressure differential between the interior volume and the external environment automatically and concurrently by facilitating gaseous diffusion and inhibiting liquid diffusion across the semipermeable membrane.

In a more detailed embodiment of the second aspect, the interior volume is occupied by, at least in part, a liquid ink, and at least a portion of the semipermeable membrane is positioned above a highest level of the liquid ink within the interior volume. In another more detailed embodiment, the interior volume is occupied by, at least in part, a liquid ink, and the semipermeable membrane is angled with respect to a level of the liquid ink within the interior volume. In yet another more detailed embodiment, the semipermeable membrane is operative to facilitate gaseous diffusion while the first surface is in concurrent fluid communication with a liquid ink and a gas. In a more detailed embodiment, a surface area available for gaseous diffusion through the semipermeable membrane is non-circular. In a further detailed embodiment, an additional step of reducing an amount of ink vapor leaving the interior volume of the ink container by reducing a volumetric flow of gas passing in proximity to the opposing surface of the semipermeable membrane is provided. In still a further more detailed embodiment, the regulating step includes providing a serpentine passageway for gaseous travel, wherein the serpentine passageway includes a first end terminating approximate the opposing surface of the semipermeable membrane and a second end terminating approximate the external environment. In yet a further more detailed embodiment, the semipermeable membrane includes polytetrafluoroethylene. In yet another detailed embodiment, the semipermeable membrane includes a cross sectional area for gaseous exchange ranging from about 0.5 $cm^2$ to about 6 $cm^2$. In even a further detailed embodiment, the mounting step includes the step of sealing the semipermeable membrane to the ink container by impulse sealing.

It is a third aspect of the present invention to provide a method of mounting a porous substrate, concurrently inhibiting liquid diffusion therethrough and enabling gaseous diffusion therethrough, to a nonporous substrate concurrently inhibiting gaseous and liquid diffusion therethrough, where the method includes the steps of: (a) positioning a porous substrate adjacent to a nonporous substrate; (b) moving a pressure source adjacent to the porous substrate to sandwich the porous substrate between the pressure source and the nonporous substrate; (c) applying thermal energy in a pulse adjacent to the porous substrate to melt a portion of the nonporous substrate; and (d) removing the thermal energy source to solidify the portion of the nonporous substrate, interlocking the porous substrate and nonporous substrate to inhibit fluid communication therebetween, where the porous substrate facilitates gaseous diffusion therethrough, but inhibits liquid diffusion therethrough.

It is a fourth aspect of the present invention to provide an ink reservoir cap adapted to be mounted to an ink tank to provide a vented ink reservoir automatically regulating the internal pressure therein, where the ink reservoir cap includes a cap body adapted to be mounted to an ink tank to provide a vented ink reservoir, the cap body and ink tank define an interior volume available for ink occupation with the cap body seating a semipermeable membrane over a vent extending therethrough, where the membrane is housed within the interior volume to provide gaseous communication, but restrict liquid communication, between an external environment and the interior volume of the vented ink reservoir.

In a more detailed embodiment of the fourth aspect, the cap body further includes a filler conduit adapted provide fluid communication between an ink source and the interior volume of the vented ink reservoir. In another more detailed embodiment, the cap body further includes a raised space in fluid communication with the semipermeable membrane, the raised space adapted to trap a volume of gas above a highest level of liquid ink within the vented ink reservoir. In a more detailed embodiment, at least a portion of the semipermeable membrane is adapted to be in gaseous communication with gas within the raised space. In a further detailed embodiment, the cap body further includes a plurality of alignment pins adapted to align the cap body with respect to the ink tank prior to mounting the cap body onto the ink tank. In still a further more detailed embodiment, the cap body and the ink tank include a channel and a corresponding rib adapted to interact with the channel to provide an interface adapted to be fluidically sealed and provide a vented ink reservoir.

DETAILED DESCRIPTION

The exemplary embodiments of the present invention are described and illustrated below as ink cartridges (reservoirs) utilizing at least one semipermeable membrane to regulate the volumetric flow of gas between an interior of an ink cartridge and an exterior environment. The various orientational, positional, and reference terms used to describe the elements of the inventions are therefore used according to this frame of reference. However, for clarity and precision, only a single orientational or positional reference will be utilized; and, therefore it will be understood that the positional and orientational terms used to describe the elements of the exemplary embodiments of the present invention are only used to describe the elements in relation to one another.

Figure 1:
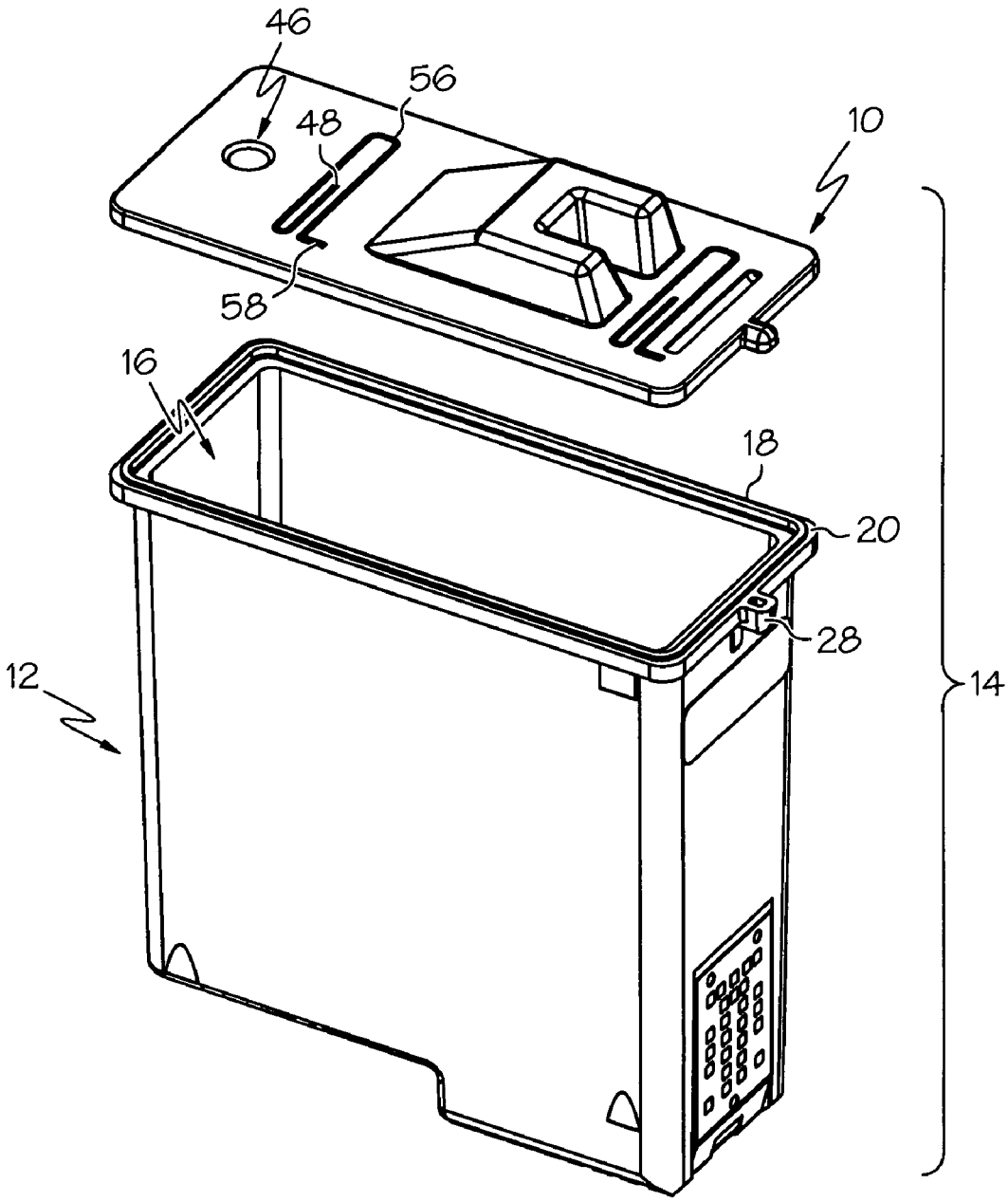
FIG. 1 is an exploded view of a vented ink reservoir in accordance with a first exemplary embodiment of the present invention.
Figure 2:
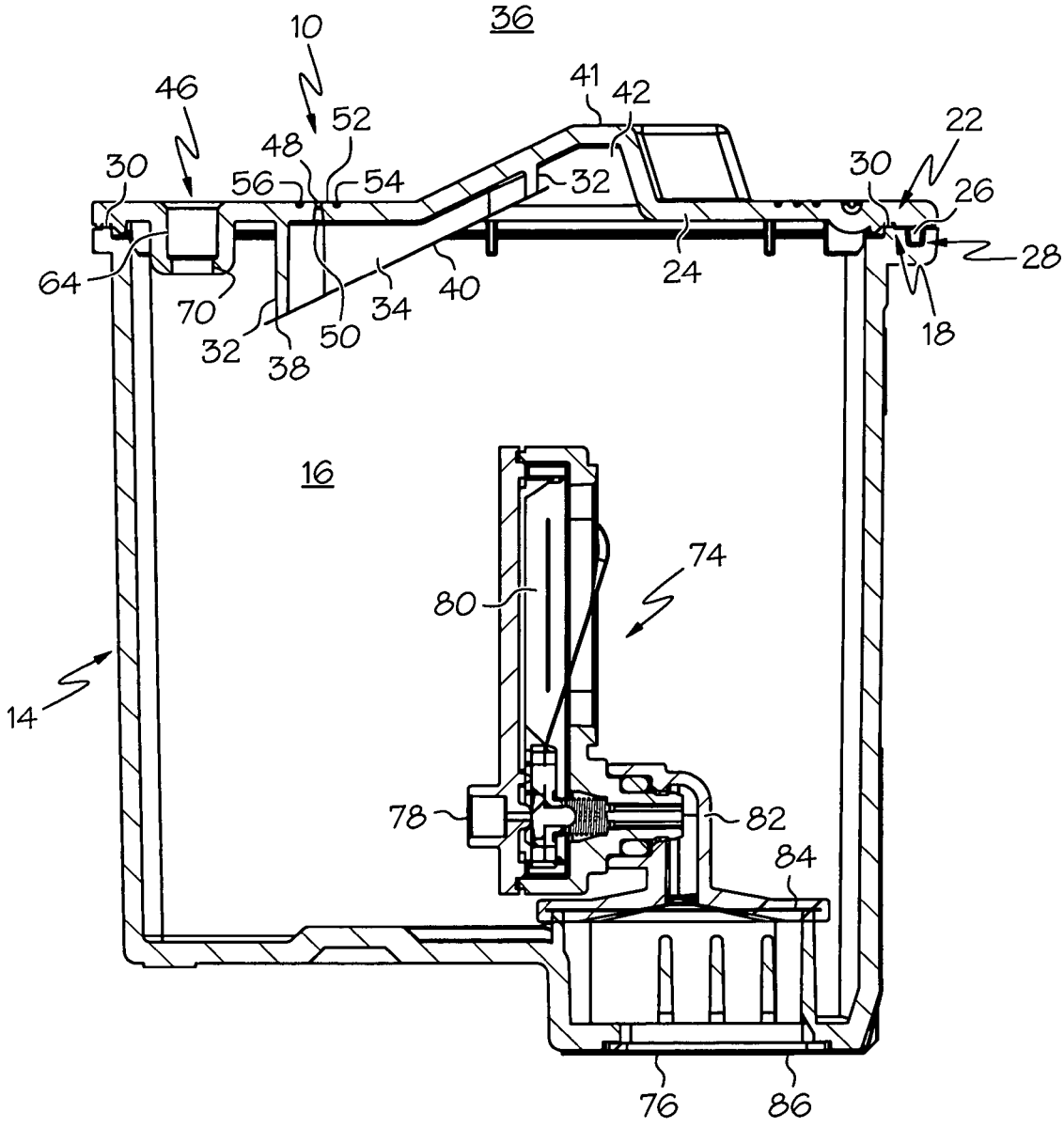
FIG. 2 is a cross-sectional view of the vented ink reservoir of the first exemplary embodiment of the present invention.

Referring to FIGS. 1–2, a first exemplary embodiment includes an ink reservoir cap 10 mounted to an ink tank 12 to provide a partially sealed ink reservoir 14 having an interior volume 16 available for holding liquid ink. A raised rib 18 running about the perimeter of a top surface 20 of the upper opening of the tank 12 is adapted to provide a seat for, and be received within, a complementary channel 22 extending along an underneath surface 24 of the cap 10. An alignment pin 26 extending downwardly from the cap 10 is adapted to be received within a socket 28 concurrently as the raised rib 18 is received within the channel 22. The cap 10 is mounted to the tank 12 by sealing an interface 30 between the rib 18 and the channel 22 using a conventional technique after the cap 10 has been aligned and seated upon the tank 12 as discussed above. Such conventional techniques are known by those of ordinary skill and include, without limitation, adhesive, laser welding, and vibration welding.

Referencing FIG. 2, a closed wall 32 extends from the underneath surface 24 of the cap 10 that partially defines a gaseous cavity 34 in gaseous communication with an external environment 36. A bottom surface 38 of the closed wall 32, opposite the surface 24, is beveled uniformly along a plane to provide a planar surface onto which a semipermeable membrane 40 is mounted thereto. In the present exemplary embodiment, the semipermeable membrane 40 is a solid rectangle that overlies the oblong shaped, closed wall 32 completely covering over the entire exposed area to partially define the gaseous cavity 34. To bond the membrane 40 thereto, an impulse sealing electrode is aligned with the bottom surface 38 of the closed wall 32 and sandwiches the membrane 40 therebetween. Thereafter, an electric current is applied for a fraction of a second to the impulse sealing electrode causing material at the bottom surface 38 to become viscous. In this viscous state, the material at the bottom surface 38 bonds to the membrane 40, resulting in a liquid-tight seal between the closed wall 32 and the membrane 40. Those of ordinary skill are familiar with other methods may be utilized to mount the membrane 40 to the closed wall 32 such as, without limitation, press fitting and insert molding.

The cap 10 includes a humped portion 41 adjacent to the cavity 34 to provide a raised space 42 within the interior volume 16 of the reservoir 14. In the present embodiment, the gaseous cavity 34 extends partially within the space 42. The cap 10 also includes an inlet orifice 46 to facilitate filling/refilling the reservoir with ink. The space 42, as shown in FIG. 2, provides a step-up in height (with respect to the inlet orifice 46) that ensures that some gas will remain within the reservoir 14 and in communication with gas within the gaseous cavity 34 by way of the semipermeable membrane 40 when the ink is at its highest level. In the orientation shown in FIG. 2, ink would spill out of an inlet orifice 46 (presuming no plug was inserted therein) before displacing the volume of gas occupying the space 42. Because the gaseous cavity 34 extends at least partially within the raised space 42, at least a portion of the membrane 40 will be exposed to gas occupying the reservoir 14 even when the ink is "full". As the level of ink within the reservoir 14 drops from usage, a larger and larger area of the membrane 40 becomes exposed for gaseous transfer between the interior 16 of the reservoir 14 and the gaseous cavity 34. Eventually, the entire membrane 40 is exposed for gaseous transfer between the cavity 34 and the interior 16 of the reservoir 14.

A cylindrical venting conduit 48 is provided through the cap 10 and includes an opening 50 in direct communication with the gaseous cavity 34 and in fluid communication with the external environment 36 by way of a tunnel 54. The tunnel 54 comprises a trench 56 originating at the cylindrical conduit 48 and traveling in a serpentine pattern within a top surface 62 of the cap 10. The trench 56 is covered by a secondary structure 52 that provides an outlet 58 to the external environment 36 opposite the cylindrical conduit 48. Exemplary secondary structures 52 include flat panels, flat panels having a corresponding trench formed therein, and corresponding concave structures operatively coupled to the cap 10 by an amendable process known to those of ordinary skill in the art.

After the cap 10 is mounted to the tank 12, the reservoir 14 is filled with ink via the inlet orifice 46. The inlet orifice 46 is in fluid communication with a first cylindrical conduit 64 extending down from the cap 10 into the interior 16 of the reservoir 14, which transitions into a second cylindrical orifice 70 in direct fluid communication with the interior 16 of the ink reservoir 14. A plug (not shown) is positioned within the first cylindrical conduit 64 after an appropriate volume of ink has been added to the reservoir 14 to seal the inlet orifice 46. An appropriate volume of ink includes an amount of ink raising the level of ink within the reservoir 14 to abut the orifice 70.

The inflow of ink into the reservoir 14 submerges an internal backpressure regulator 74 in fluid communication with a printhead 76. The backpressure regulator 74 regulates the volume of ink passing between the reservoir 14 and the printhead 76 to prevent weeping when printing operations are no longer desired. The regulator 74 includes an inlet 78 that provides selective fluid communication between an interior 80 of the regulator 74 and the reservoir 14. The ink stream flows through the regulator 74, through an ink filter cap 82, through an ink filter 84, and is eventually delivered to a plurality of nozzles 86 on the face of the printhead 76. The exterior of the backpressure regulator 74 is fully submerged when the ink reservoir 14 is full, and becomes partially submerged as ink within the reservoir 14 is consumed below a certain point. For a more detailed discussion of the operation of the backpressure regulator 74, see co-pending U.S. patent application Ser. No. 10/465,403.

In a completely sealed reservoir, ink leaving the reservoir would decrease the internal pressure of the reservoir, as the internal volume of the reservoir remains the same, but the volume of ink within the reservoir has decreased. This gradual decrease in internal pressure within the reservoir decreases the pressure differential between the exterior of the regulator 74 and the interior 80 of the regulator. It is preferred to maintain this pressure differential between the exterior of the regulator 74 and the interior 80 of the regulator by enabling gaseous diffusion between the interior volume 16 and the external environment 36.

The membrane 40 in accordance with the present invention allows gas to flow between the exterior environment 36 and the interior 16 of the reservoir 14 by way of the cylindrical venting conduit 48, but substantially inhibits liquid (ink) from passing therethrough. Accordingly, the semipermeable membrane 40 may be a material having very small pores selectively allowing gas to flow therethrough, but inhibiting a liquid from passing therethrough. At extremely high pressure levels a liquid might be forced through the pores of the membrane 40, but such pressures are seldom seen during normal printhead operation. The semipermeable membrane 40 may comprise a single material or a composite material and may also include multiple layers of a unitary or composite material. An exemplary material comprising the semipermeable membrane 40 in accordance with the present invention is a single layer polytetrafluoroethylene (PTFE) membrane from W. L. Gore & Associates (www.gore.com).

As with any porous material, there is a pressure drop associated with gas passing through the membrane 40. Several factors may be considered to minimize the effect of this pressure drop on the backpressure regulator 74. The area of the membrane 40 available for gaseous transfer is partially determinative of the volumetric flow of gas that can pass through the membrane 40 at a given pressure. To reduce production costs, however, it is desired that the area of the membrane 40 be relatively small. Thus, an optimization of this area accounts for productions costs versus the maximum potential volumetric flow rate of gas during normal operation of the printhead 76.

An additional factor that may be considered is the shape of the membrane 40 exposed to the ink. The pressure drop may increase across the membrane 40 as the exposure to ink is increased. The shape of the membrane may determine, in part, how quickly the membrane 40 recovers from being directly exposed to ink and provides gaseous communication through those areas. A circular shaped membrane 40 may not be optimal as a single spherical bubble of ink might block the path of gas through the entire membrane 40. The potential for the natural, spherical shape of the bubble to completely block the membrane becomes less likely as the shape of the membrane 40 deviates from being circular.

Figure 3:
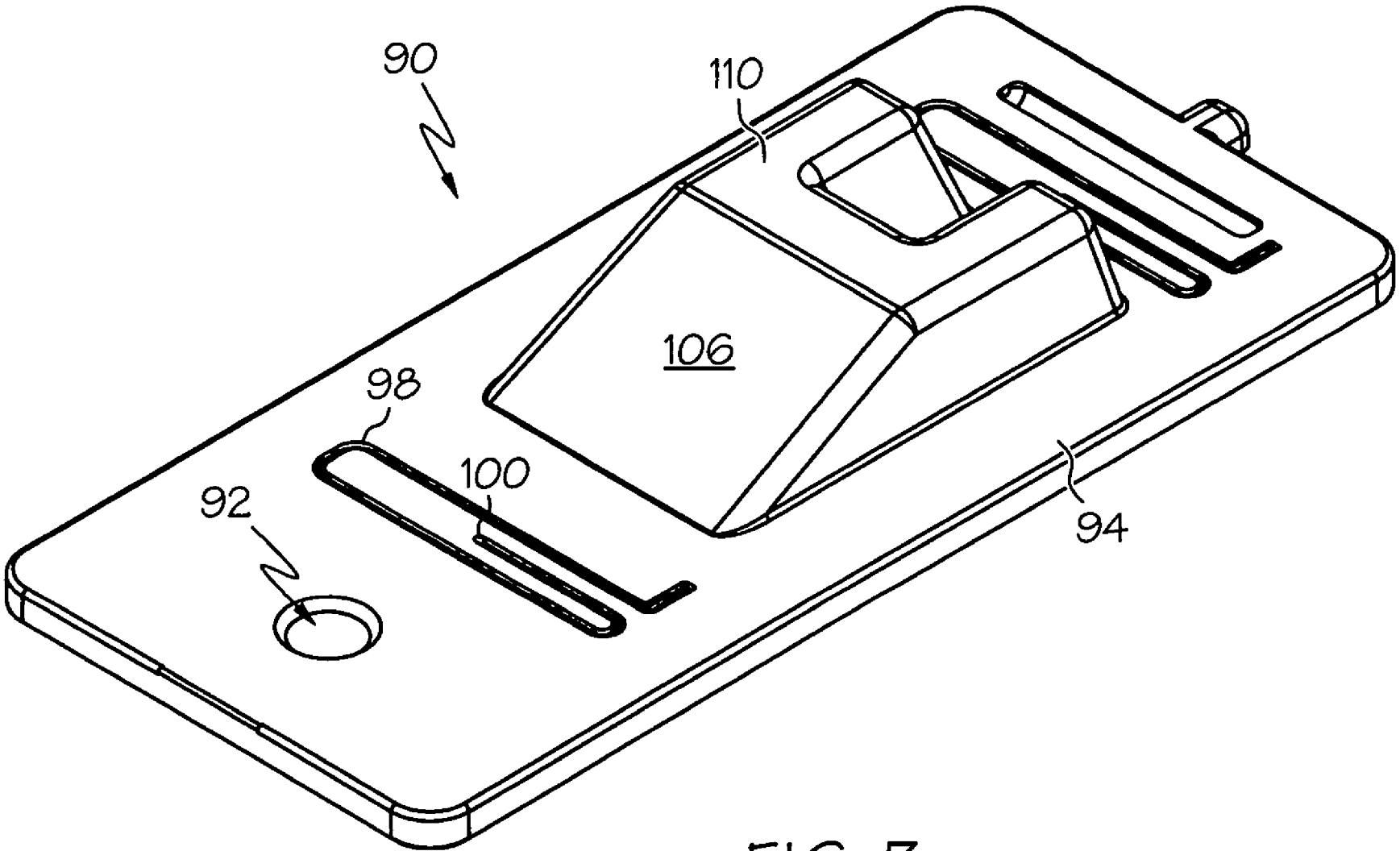
FIG. 3 is an elevated, perspective view of the top of an ink reservoir cap in accordance with a second exemplary embodiment of the present invention.
Figure 4:
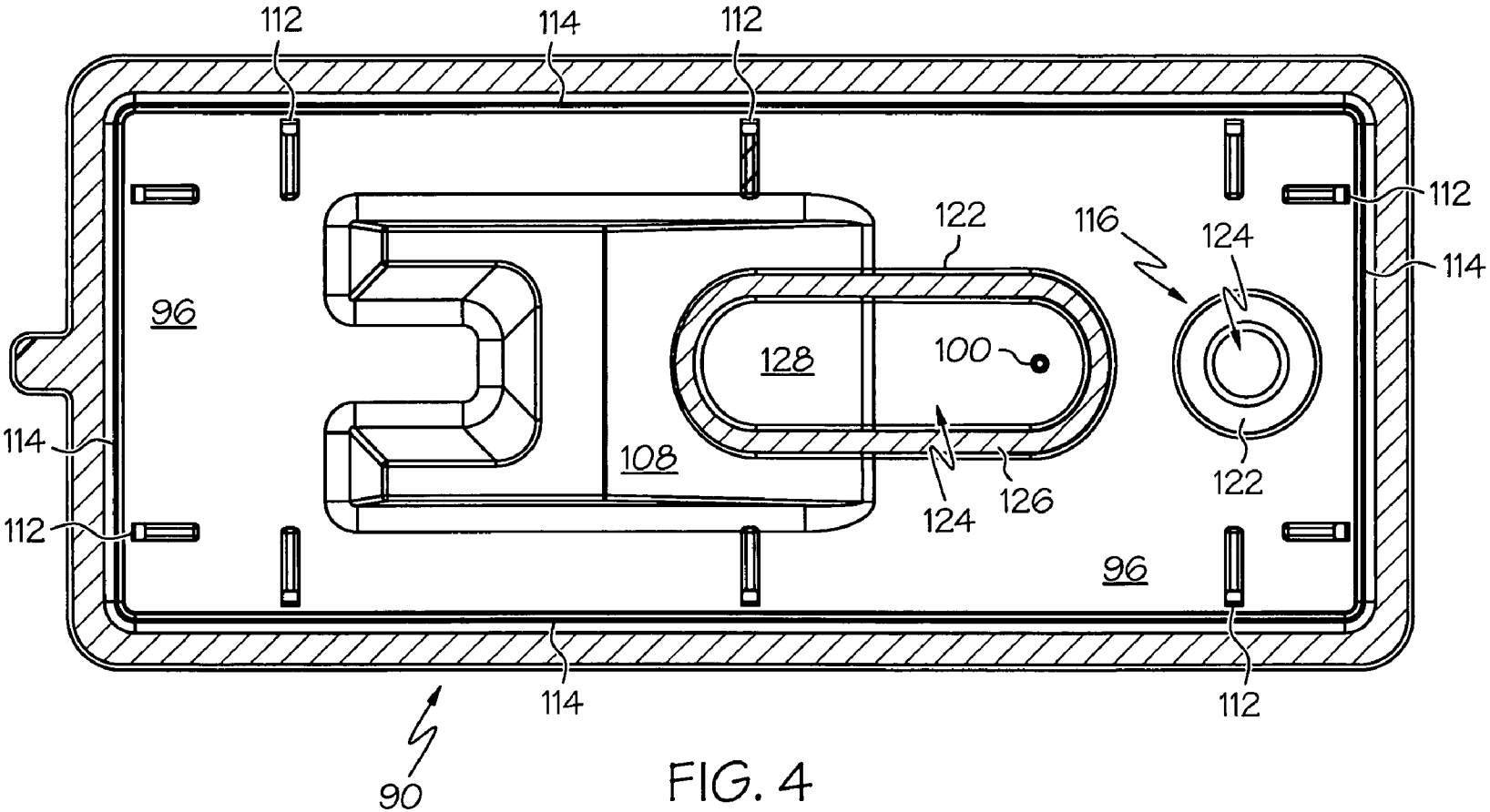
FIG. 4 is a bottom view of the ink reservoir cap of FIG. 3.
Figure 5:
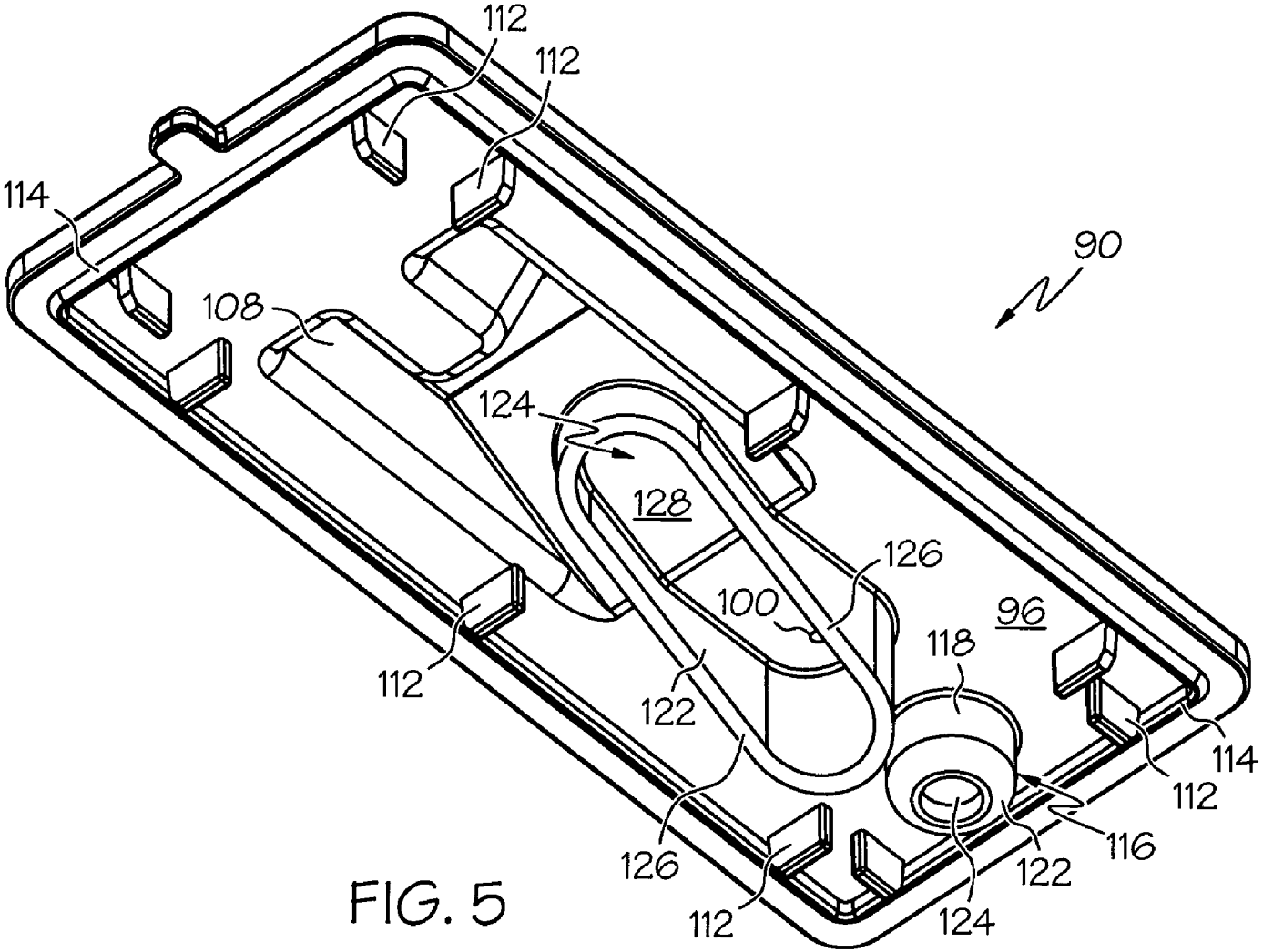
FIG. 5 is a bottom, perspective view of the ink reservoir cap of FIG. 3.

Referencing FIGS. 3–5, a second exemplary ink reservoir cap 90 is shown that is adapted to be mounted to a corresponding structure, such as an ink tank, to provide a vented ink reservoir (similar to the embodiment shown in FIGS. 1 and 2). The ink reservoir cap 90 includes an ink inlet 92 and a serpentine channel 98, adjacent to the ink inlet 92, having a vent hole 100 at a first end, while a second end terminates on the top surface 94 of the cap 90. The cap 90 is attached to the reservoir and includes a channel 98 adapted to be covered to create a serpentine tunnel venting to the external environment. A humped portion 106 of the cap 90 creates a space 108 that is above the top surface 94. The humped portion 106 includes a planar, U-shaped top surface 110 being joined by eight side surfaces beveled at the adjoining ends.

Referencing FIGS. 4 and 5, the bottom surface 96 includes a plurality of alignment posts 112 that are utilized to align the ink reservoir cap 90 onto the corresponding structure to provide an ink reservoir. A lip 114 protrudes from the bottom surface 96 to form a rectangular rib surrounding and abutting the alignment posts 112 that is adapted to be received by an interior wall of the corresponding structure.

A nodule 116 inside of the lip 114 includes a cylindrical wall 118 transitioning into a domed shaped end 120 in fluid communication with the ink inlet 92. Adjacent to the nodule 116 is a continuous oval shaped wall 122 defining a cavity 124 adapted to be fluidically sealed by a semipermeable membrane (not shown) and provide a gaseous area. The top surface 126 of the wall is angled uniformly to receive the semipermeable membrane mounted thereto to inhibit liquid from entering the cavity 124.

A portion 128 of the cavity 124 opposite the nodule 116 is located within the elevated space 108. The space 108 is adapted to trap a minimum amount of gas within the reservoir when the reservoir is filled with ink to ensure that at least the portion of the cavity 124 is in gaseous communication with such trapped gas. If the pressure within the vented reservoir were to increase above that of the external environment, a percentage of the trapped gas would pass through the semipermeable membrane, into the cavity 124, through the vent hole 100, through the serpentine tunnel and into gaseous communication with an external environment. An opposite process would take place if the pressure within the vented reservoir were to decrease with respect to the external environment.

Following from the above description and invention summaries, it should be apparent to those of ordinary skill in the art that, while the methods and apparatuses herein described constitute exemplary embodiments of the present invention, the inventions contained herein are not limited to these precise embodiments and that changes may be made to them without departing from the scope of the invention as defined by the claims. Additionally, it is to be understood that the invention is defined by the claims and it is not intended that any limitations or elements describing the exemplary embodiments set forth herein are to be incorporated into the meanings of the claims unless such limitations or elements are explicitly recited in the claims. Likewise, it is to be understood that it is not necessary to meet any or all of the identified advantages or objects of the invention disclosed herein in order to fall within the scope of any claim, since the invention is defined by the claims and since inherent and/or unforeseen advantages of the present invention may exist even though they may not have been explicitly discussed herein.

What is claimed is:

1. An inkjet assembly comprising:

a vented ink reservoir for containing a liquid ink therein, the vented ink reservoir defining an internal volume occupied at least in part by a semipermeable membrane in fluid communication with a vent that automatically adjusts for pressure differentials by enabling gaseous diffusion between an environment external to the vented ink reservoir and the internal volume of the vented ink reservoir and concurrently inhibiting liquid diffusion therethrough, wherein at least a portion of the semipermeable membrane is angled other than parallel with respect to an operating level of the liquid ink within the vented ink reservoir;

wherein:

the vented ink reservoir includes a cap mounted to a tank;

the semipermeable membrane is mounted to the cap;

the cap includes a raised hump providing a space adapted to trap gas therein above a highest level of liquid ink within the vented ink reservoir; and at least a portion of the semipermeable membrane extends into the space provided by the raised hump.

2. The inkjet assembly of claim 1, wherein the semipermeable membrane defines a non-circular gaseous throughput.

3. The inject assembly of claim 1, wherein the semipermeable membrane includes a cross-sectional area for gaseous throughput ranging from between about 0.5 $cm^2$ to about 6 $cm^3$.

4. The inkjet assembly of claim 1, wherein the cap includes an ink inlet adapted to be in fluid communication with the internal volume of the vented ink reservoir.

5. The inkjet assembly of claim 1, wherein the cap includes a serpentine tunnel extending therealong in fluid communication with the vent.

6. An inkjet assembly comprising:

a vented ink reservoir for containing a liquid ink therein, the vented ink reservoir defining an internal volume occupied at least in part by a semipermeable membrane in fluid communication with a vent that automatically adjusts for pressure differentials by enabling gaseous diffusion between an environment external to the vented ink reservoir and the internal volume of the vented ink reservoir and concurrently inhibiting liquid diffusion therethrough, wherein at least a portion of the semipermeable membrane is angled other than parallel with respect to an operating level of the liquid ink within the vented ink reservoir;

wherein:

the vented ink reservoir includes a cap mounted to a tank;

the semipermeable membrane is mounted to the cap;

an underside of the cap, partially defining the internal volume of the vented ink reservoir, includes a downwardly extending closed wall mounted to the semipermeable membrane than cooperate to at least partially define a gaseous cavity within the internal volume; and at least a portion of the gaseous cavity extends into the liquid ink when the vented ink reservoir is full of liquid ink.

7. The inkjet assembly of claim 6, wherein the semipermeable membrane defines a non-circular gaseous throughput.

8. The inkjet assembly of claim 6, wherein the cap includes an ink inlet adapted to be in fluid communication with the internal volume of the vented ink reservoir.

9. The inkjet assembly of claim 6, wherein the cap includes a serpentine tunnel extending therealong in fluid communication with the vent.

10. An inkjet assembly comprising:

a vented ink reservoir for containing a liquid ink therein, the vented ink reservoir defining an internal volume occupied at least in part by a semipermeable membrane in fluid communication with a vent that automatically adjusts for pressure differentials by enabling gaseous diffusion between an environment external to the vented ink reservoir and the internal volume of the vented ink reservoir and concurrently inhibiting liquid diffusion therethrough, wherein at least a portion of the semipermeable membrane is angled other than parallel with respect to an operating level of the liquid ink within the vented ink reservoir;

wherein:

the vented ink reservoir includes a cap mounted to a tank; the semipermeable membrane is mounted to the cap;

an underside of the cap includes a downwardly extending closed wall to which the semipermeable membrane is mounted thereto to at least partially define a gaseous cavity within the internal volume; and a top side of the cap includes a humped portion corresponding to an elevated cavity within the underside of the cap adapted to be occupied by a trapped gas, where at least a portion of the semipermeable membrane is in communication with the trapped gas.

11. The inkjet assembly of claim 10, wherein at least a portion of the elevated cavity is occupied by the gaseous cavity.

12. The inkjet assembly of claim 10, wherein the semipermeable membrane defines a non-circular gaseous throughput.

13. The inkjet assembly of claim 10, wherein the cap includes an ink inlet adapted to be in fluid communication with the internal volume of the vented ink reservoir.

14. The inkjet assembly of claim 10, wherein the cap includes a serpentine tunnel extending therealong in fluid communication with the vent.

15. An ink reservoir cap adapted to be mounted to an ink tank to provide a vented ink reservoir automatically regulating the internal pressure therein, the ink reservoir cap comprising:

a cap body adapted to be mounted to an ink tank to provide a vented ink reservoir, the cap body and ink tank define an interior volume available for ink occupation and the cap body includes a semipermeable membrane covering a vent extending therethrough, the membrane is housed within the interior volume to provide gaseous communication, but restrict liquid communication, between an external environment and the interior volume of the vented ink reservoir, wherein gaseous diffusion across the semipermeable membrane can occur when liquid ink is in direct contact with the semipermeable membrane;

wherein the cap body further includes a raised space in fluid communication with the semipermeable membrane, the raised space adapted to trap a volume of gas above a highest operating level of liquid ink within the vented ink reservoir.

16. The ink reservoir cap of claim 15, wherein at least a portion of the semipermeable membrane is adapted to be in communication with gas within the raised space.

17. The ink reservoir cap of claim 15, wherein the cap body further includes a plurality of alignment pins adapted to align the cap body with respect to the ink tank prior to mounting the cap body onto the ink tank.

18. The ink reservoir cap of claim 15, wherein the cap body and the ink tank include a channel and a corresponding rib adapted to interact with the channel to provide an interface adapted to be fluidically sealed and provide a vented ink reservoir.

19. A method of regulating the pressure between an interior volume of an ink container and an external environment, the method comprising the steps of:

mounting a semipermeable membrane to an interior conduit extending into an interior of an ink container;

inputting ink into the ink container to partially submerge the semipermeable membrane and partially submerge the interior conduit, where the semipermeable membrane is angled between 15 degrees and 75 degrees with respect to an operating level of ink within the ink container as ink is withdrawn from the ink container, where at least a portion of the semipermeable membrane is in fluid communication with an air pocket formed within a highest location within the ink container, and where the ink container includes a fill orifice that is vertically lower than the air pocket; and regulating a pressure differential between the interior volume and the external environment facilitating gaseous diffusion through the semipermeable membrane and inhibiting liquid diffusion through the semipermeable membrane.

* * * * *